US011197802B2

(12) United States Patent
Lee

(10) Patent No.: US 11,197,802 B2
(45) Date of Patent: Dec. 14, 2021

(54) VIAL ADAPTOR AND FLUID TRANSFER SYSTEM

(71) Applicant: EPIC MEDICAL PTE LTD, Singapore (SG)

(72) Inventor: Freddie Eng Hwee Lee, Singapore (SG)

(73) Assignee: EPIC MEDICAL PTE. LTD., Singapore (SG)

( * ) Notice: Subject to any disclaimer, the term of this patent is extended or adjusted under 35 U.S.C. 154(b) by 576 days.

(21) Appl. No.: 16/109,843

(22) Filed: Aug. 23, 2018

(65) Prior Publication Data

US 2019/0060171 A1 Feb. 28, 2019

Related U.S. Application Data

(60) Provisional application No. 62/549,669, filed on Aug. 24, 2017.

(51) Int. Cl.

| | |
|---|---|
| ***A61J 1/14*** | (2006.01) |
| ***A61J 1/18*** | (2006.01) |
| ***A61J 1/20*** | (2006.01) |

(52) U.S. Cl.

CPC ..... *A61J 1/2096* (2013.01); *A61J 1/1406* (2013.01); *A61J 1/18* (2013.01); *A61J 1/201* (2015.05);

(Continued)

(58) Field of Classification Search

CPC ..... A61J 1/2096; A61J 1/1406; A61J 1/2037; A61J 1/18; A61J 1/2051; A61J 1/2072;

(Continued)

(56) References Cited

U.S. PATENT DOCUMENTS

2002/0040206 A1* 4/2002 Heil ..... A61J 1/2096 604/202
2015/0265500 A1* 9/2015 Russo ..... A61J 1/2096 604/239

(Continued)

FOREIGN PATENT DOCUMENTS

DE 102015201288 A1 7/2016

OTHER PUBLICATIONS

European Patent Application No. 18190565.4; Extended Search Report; dated Jan. 31, 2019; 5 pages.

*Primary Examiner* — Nicholas J. Weiss
*Assistant Examiner* — Alessandro R Del Priore
(74) *Attorney, Agent, or Firm* — BakerHostetler

(57) ABSTRACT

A vial adaptor comprises first and second housings coupled to each other, a sheath enclosing the first and second housings, and a spike disposed in the first and second housings. The first and second housings form a first chamber therein. The sheath and the first and second housings form therebetween a second chamber in air communication with the first chamber. The second housing is slidable relative to the first housing to cause the spike piercing through a front stopper to establish air and fluid communication with a vial attached to the vial adaptor, meanwhile to vary the volume of the first chamber and press the air into the second chamber. Upon a fluid being drawn from the vial, the air in the first and second chambers enters the vial to compensate the pressure reduction caused by the fluid drawn out to prevent fluid spillage or aerosolizing from the vial.

31 Claims, 9 Drawing Sheets

(52) U.S. Cl.
CPC ..... *A61J 1/2037* (2015.05); *A61J 1/2051* (2015.05); *A61J 1/2055* (2015.05); *A61J 1/2072* (2015.05); *A61J 1/2082* (2015.05); *A61J 1/2006* (2015.05); *A61J 2200/70* (2013.01)

(58) Field of Classification Search
CPC ..... A61J 1/2055; A61J 1/201; A61J 2200/70; A61J 1/2006; A61J 1/2075; A61J 1/2082; A61J 1/20–2096
See application file for complete search history.

(56) References Cited

U.S. PATENT DOCUMENTS

| | | | | |
|---|---|---|---|---|
| 2016/0271017 | A1* | 9/2016 | Weir ..... | A61J 1/2096 |
| 2017/0367931 | A1* | 12/2017 | Eichelkraut ..... | A61J 1/2055 |
| 2021/0002039 | A1* | 1/2021 | Harman ..... | A61J 1/2096 |

* cited by examiner

VIAL ADAPTOR AND FLUID TRANSFER SYSTEM

CROSS-REFERENCE TO RELATED APPLICATIONS

This claims priority to U.S. Patent Application Ser. No. 62/549,669 filed Aug. 24, 2017, the disclosure of which is hereby incorporated by reference as if set forth in its entirety herein.

TECHNICAL FIELD

The present invention relates to a medical device and particularly to a vial adaptor and system for transferring medical contents such as liquid medicine between a storage container and an intermediary device such as a syringe for administration.

BACKGROUND

Medicines are transferred from its source containers e.g. vials, rigid or flexible bags to intermediary devices like syringes or to final devices, before introduction to patients by infusion or injections. The transfer process presents risks of exposing medical contents to aerosols, vapors and leakages. The adverse health implications resulting from inhalations and exposure of hazardous drugs has been a major concern in the medical field.

SUMMARY

The disclosed embodiments relate to a vial adaptor and system for transferring fluids between a source container such as a vial and an administering device such as a syringe, that reduces the risks of fluid spillage or aerosolizing from the vial. This is achieved in part by providing pressure equalization in the vial when the content is drawn out of the vial such that there is no buildup of pressure or vacuum to cause spillage or aerosolizing at the point where the syringe is disconnected from the vial.

In one aspect, embodiments disclosed therein provide a vial adaptor comprising a first housing, a second housing movably coupled to the first housing, a spike disposed in the first housing and the second housing, and a sheath disposed surrounding the first and second housings. The first housing and the second housing form a first chamber therein. The spike having a tip positioned adjacent to a front end of the first housing, a fluid port connected to a back end of the second housing, a first fluid channel opening at the tip and connected to the fluid port, and a second fluid channel opening at the tip and connected to the first chamber. The second chamber is in air communication with the first chamber. With a vial attached to the vial adaptor, the displacement of the second housing toward the first housing advances the tip of the spike to protrude out of the first housing and positioned in the vial to establish air and fluid communication with an internal space of the vial. The displacement of the second housing toward the first housing causes air in the first chamber to enter the second chamber through the vial.

In another aspect, embodiments disclosed therein provide system for fluid transfer between a fluid container such as a vial, and an administering device such as syringe. The fluid transfer system comprises a vial adaptor, a vial and a syringe attached to the vial adaptor. The vial adaptor comprises a first housing, a second housing movably coupled to the first housing, a spike disposed in the first housing and the second housing, and a sheath disposed surrounding the first and second housings. The first housing and the second housing form a first chamber therein. The spike having a tip positioned adjacent to a front end of the first housing, a fluid port connected to a back end of the second housing, a first fluid channel opening at the tip and connected to the fluid port, and a second fluid channel opening at the tip and connected to the first chamber. The second chamber is in air communication with the first chamber. The vial is attached to the front end of the first housing of the vial adaptor. The syringe is attached to the fluid port of the spike of the vail adaptor. Upon protruding out of the first housing, the tip of the spike is positioned in the vial and air in the first chamber enters the second chamber through the vial. Upon withdrawal of a volume of liquid out of the vial into the syringe through the second fluid channel of the spike, air from the first chamber enters the vial to fill the vacuum created in the vial.

These and other aspects and advantages of the present application will become apparent from the following detailed description, illustrating by way of example the inventive concept and technical solution of the present application.

BRIEF DESCRIPTION OF THE DRAWINGS

Embodiments of the present application are disclosed hereinafter with reference to the drawings, in which.

DETAILED DESCRIPTION OF THE PREFERRED EMBODIMENTS

Figure 1:
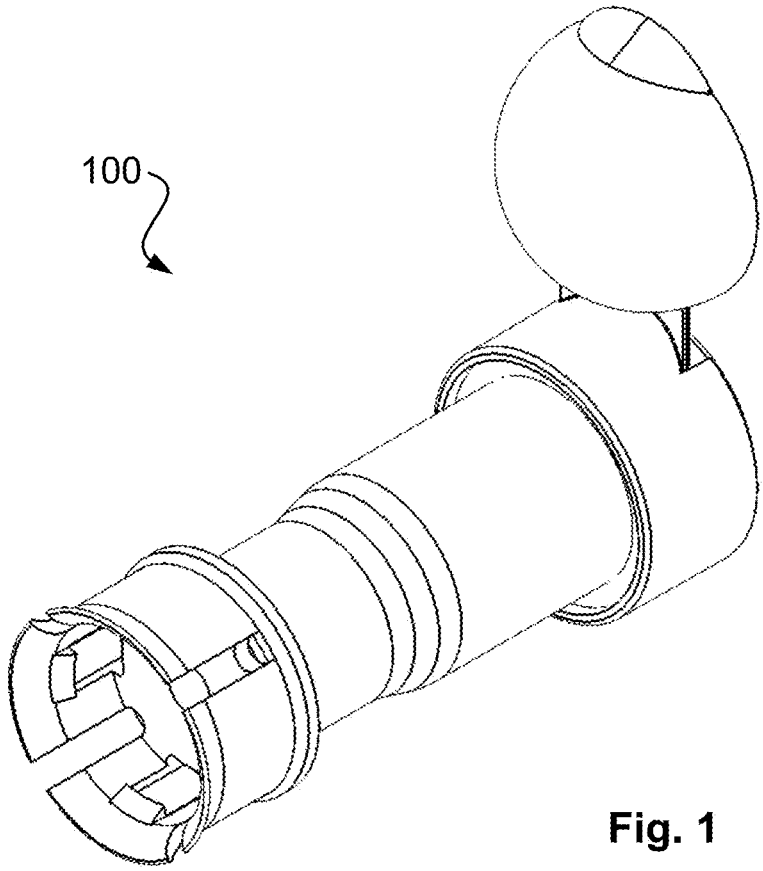
FIG. 1 is a perspective view of a vial adaptor according to one embodiment of the present invention.
Figure 2:
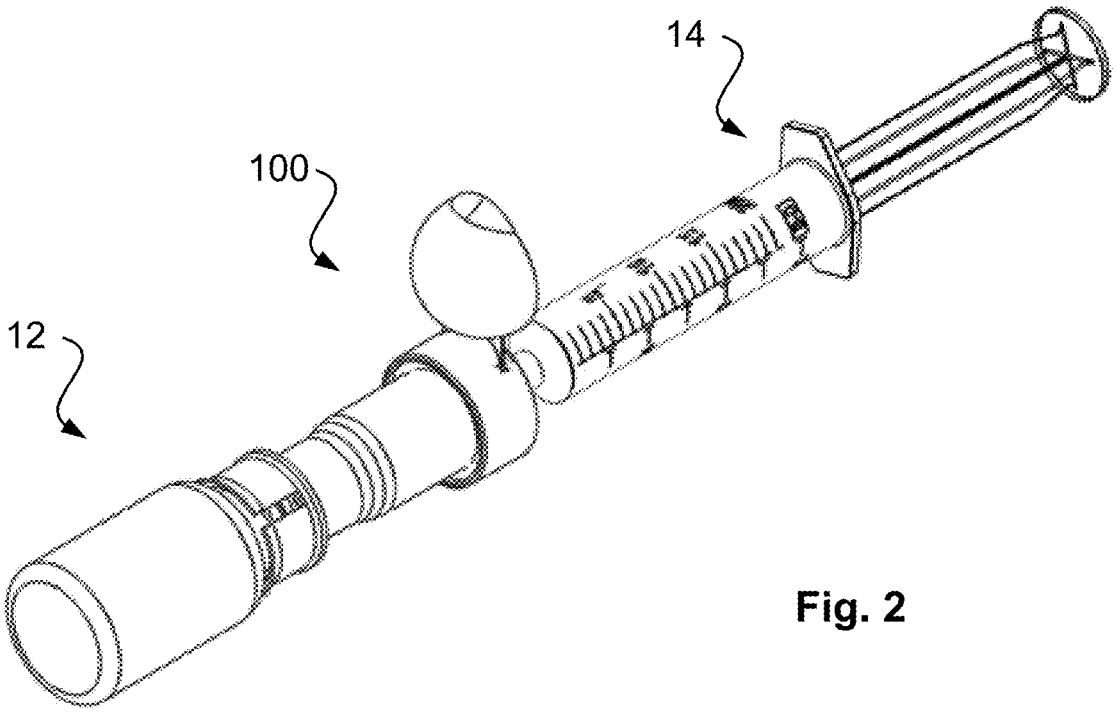
FIG. 2 is a perspective view of a fluid transfer system in which a vial adaptor of FIG. 1 is attached to a vial and a syringe.
Figure 3:
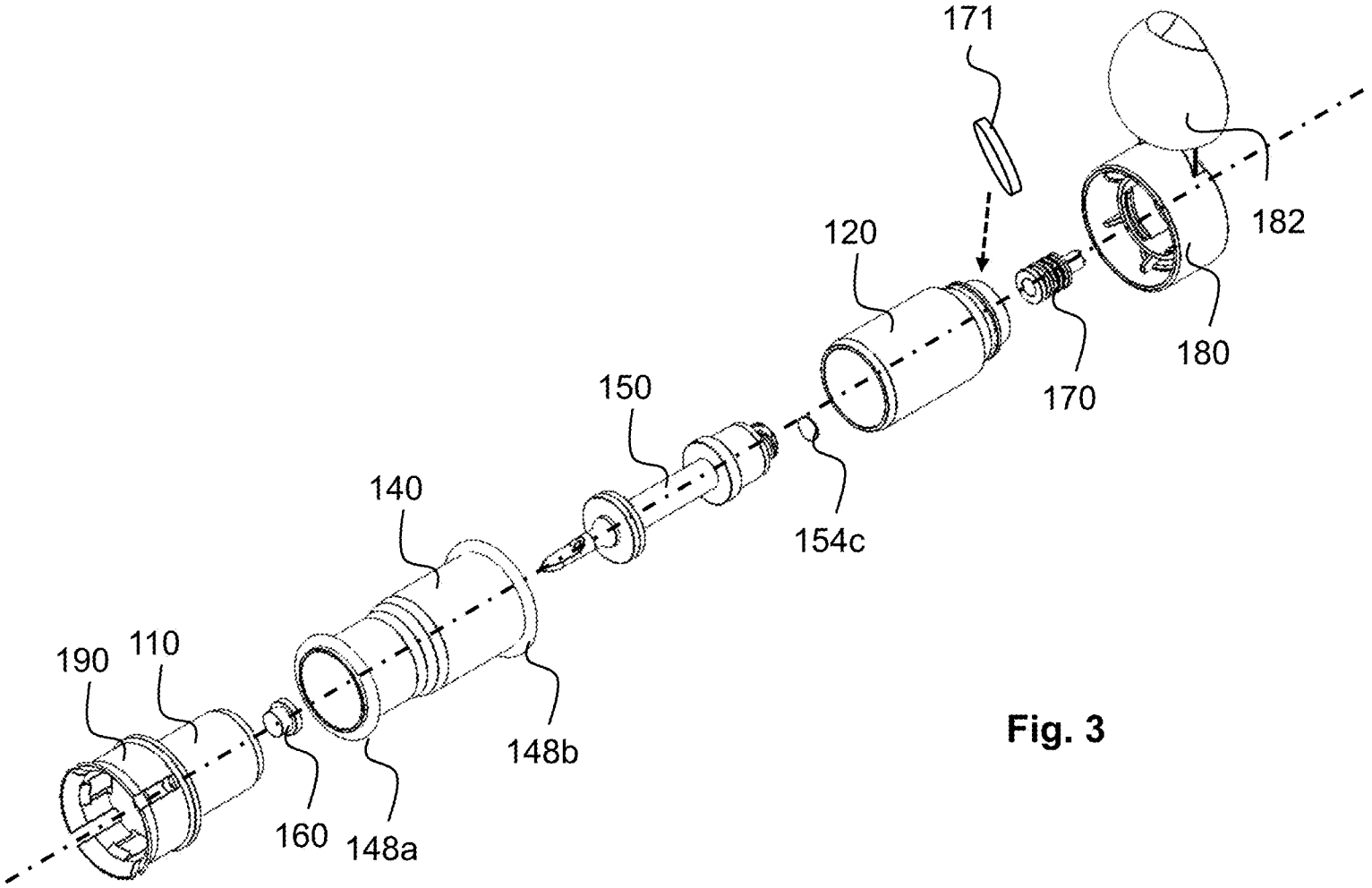
FIG. 3 is an exploded view of the vial adaptor of FIG. 1.

Embodiments will be illustrated in detail herein to provide an understanding of the principles and implementation of the invention features, functions, manufacture, use of the device and methods disclosed. The embodiments shown are intended to be exemplary and non-limiting. The features described in one embodiment may be combined with variants, alternatives and/or modifications of other embodiments to achieve the goals of a device with the features and novelties described. Such variants, alternatives or modifications are intended to be within the scope of the present disclosure.

The disclosed invention embodiments allow the contents in a medication container, for example but not limited to a vial, to be transferred to an administering device such as a medical syringe. The vial adaptor has a generally cylindrical construction, comprising a hollow mandrel including a first housing and a second housing movably coupled to the first housing. The hollow mandrel has a first end covered by a cap configured to secure to the stopper of a vial and a second end formed with a fluid port that is adapted to connect to a syringe or a syringe adaptor to enable fluid transfer between the vial and the syringe. The mandrel has a first chamber formed in the midsection that is both expandable and retractable to vary the volume of the first chamber. The first chamber forms a volume space within the first chamber which encapsulates air that is sealed and isolated from the ambient air external to the vial adaptor. The first chamber is enclosed by an expandable sheath affixed surrounding the hollow tubular mandrel in such a manner that contraction of the volume space within of the first chamber is limited to the dimensions of the mandrel.

The sheath may be made of pliable material, and is firmly secured in an air-tight manner at one end to a fixed position on the second housing of the mandrel to which a spike is affixed. The other open end of the tubular sheath is secured to the first housing of the mandrel that is an integral part of the cap like end that secures to the vial stopper when the vial adaptor is in use. The first and second housings of the mandrel are slidable relative to each other. A displacement of the first and second housings in an axial direction towards each other results in a reduction of the distance between the secured ends of the tubular sheath causing an unflexing of the sheath.

Such a displacement occurs when the bottom cap is secured to the vial stopper and the spike within the first chamber pierces through the stopper by a force acting on the top cap in a direction toward the vial stopper. The first housing of the mandrel is forced into the cavities of the second housing of the mandrel causing the air within the first chamber to enter the second chamber to unflex/expand the sheath. Depending on the state of air space inside the vial, air may be drawn from the volume space encapsulated by the sheath to equalize any pressure differential prevailing between the vial and the chamber.

The spike has a first fluid channel and a second fluid channel formed therein. The first fluid channel opens at the tip of the spike, to establish fluid communication between the fluid port to which a syringe would be connected and the contents of the vial through the tip. The second channel opens at the tip of the spike, to establish air communication between the volume space of the first chamber and the air above the liquid level in the vial when the vial is in an upright position. In this upright position, when the fluid contents are not in contact with the inner surface of the vial stopper, any administration of air into the vial from the vial adaptor will cause the air to be displaced through the second channel into the first chamber, and to further enter the second chamber to expand the sheath. The expansion of the sheath will produce a pressure equalization in the vial. When the vial adaptor is used to inject fluid from the syringe into the vial, the administration of fluid into the vial will similarly provide pressure equalization in the vial.

Drawing fluid out of the vial requires the vial to be inverted such that the extremity of the first channel of the spike is below the fluid level in the vial. The air space above the fluid level has a lower pressure hence no fluid will flow into the second channel of the spike which has a higher pressure due to the air retained in the unflexed sheath i.e. the expandable second chamber. The action of the syringe plunger's retraction causes fluid to flow into the syringe from the vial through the vial port and the first channel of the spike. The expansion in the air space above the fluid level in the vial results in a further pressure reduction, which is subsequently filled by an air from the sheath entering the vial through the second channel of the spike, to compensate the air pressure reduction in the vial caused by the fluid drawn out. The transfer of fluids from the vial to the syringe can therefore takes place in a closed volume space with pressure equalization.

The fluid port that connects to the syringe is predisposed with a pliable valve member that keeps the fluid port closed at all times. The valve member has bellow shaped folds that lends a spring like characteristic to the valve member when the valve member is compressed. The action of the tip of a syringe that is connected to the fluid port will cause the valve member to be compressed and expose the first channel on the inside walls of the fluid port to the proximity of the end of the syringe tip, such that a fluid transfer path is created between the vial adaptor and the syringe. Fluid could flow into and out of the vial adaptor with the syringe plunger retracting from the syringe barrel for drawing fluid out of the vial, or with the syringe plunger insertion into the syringe barrel for injecting fluid into the vial, respectively.

When the syringe is disconnected from the vial adaptor, the valve member springs back to its initial state causing a suction effect to act on any fluids in the fluid port of the vial adaptor. This action reduces the occurrence of any residual fluid from being expelled out of the fluid port and appearing on the external surface of the valve member.

In another embodiment, the vial adaptor may include a septum sealed to the fluid port. The septum may be made from a pliable rubber, thermoplastic elastomer or silicon that allows the use of sharp introducers like needles to pierce through to form the fluid communication between the vial adaptor and an intermediate device like a syringe. The septum in this example do not have valve action.

The vial adaptor allows safe transfer of medications in particular cytotoxic drugs between vials and a syringe. The caps integrated within the vial adaptor minimize the need to clean the surfaces. In addition, the ergonometric rounded profile of the top cap enables easy push action in piercing the vial stopper during operation.

By way of a non-limiting example, FIGS. 1, 2, 3, 4A, 4B, 4C and 4D depict a vial adaptor 100 in accordance with one embodiment of the present disclosure, for transferring fluid such as liquid medicine between a storage container such as a vial 12, and a medicine administering device such as a syringe 14. The vial adaptor 100 comprises a first housing 110, a second housing 120 telescopically coupled to the first housing 110, a sheath 140 enclosing the first and second housings 110 and 120, and a spike 150 disposed in the first and second housings 110 and 120.

In the present embodiment, the first housing 110 and the second housing 120 are sleeve-shaped, and assembled together to form a mandrel. The first housing 110 has a front opening 112. The second housing 120 has a back opening 128. The second housing 120 is coaxially coupled to the first housing 110, and second housing 120 is slidable relative to the first housing 110 along a central axis 108 of the first and second housings 110 and 120, between a first position P1 at which a major portion of the first housing 110 is positioned outside of the second housing 120, and a second position P2 at which a major portion of the first housing 110 is positioned inside the second housing 120.

A first chamber 130 is formed in the first housing 110 and second housing 120, between the front opening 112 of the first housing 110 and the back opening 128 of the second housing 120. An annular gap 115 is formed between the first housing 110 and the second housing 120. The first housing 110 and the second housing 120 may be overlapped by a sidewall segment 113 (FIG. 4A), and the annular gap 115 is formed along the sidewall segment 113. When the second housing 120 is at the first position P1, the first chamber 130 has a first volume V1. When the second housing 120 is at the second position P2, the first chamber 130 has a second volume V2 which is smaller than the first volume V1.

The sheath 140 has a first opening 142 secured to first housing 110 surrounding the front opening 112, and a second opening 148 secured to the second housing 120 surrounding the back opening 128, such that between the sheath 140 and the external surfaces of the first housing 110 and the second housing 120 there is form a second chamber 146.

The second chamber 146 and the first chamber 130 are connected in air communication with each other via the annular gap 115. The vial adaptor 100 may include sealing elements such as O-rings 148*a*, 148*b* gripping the first opening 142 and second opening 148 of sheath 140 to the first housing 110 and second housing 120, respectively, in an air-tight manner. As such, the first chamber 130 and the second chamber 146 are isolated from the ambient atmosphere by the sheath 140. Preferably, the first chamber 130 is filled with sterilized air 131 therein.

The spike 150 is a generally elongated element having a front end 150*a* and a back end 150*b*. The back end 150*b* of the spike 150 is fixed to the second housing 120, hence the spike 150 is movable following the sliding action of the second housing 120 relative to the first housing 110. The spike 150 has a tip 152 formed at the front end 150*a*, a fluid port 158 formed at the back end 150*b*, a first channel 154 and a second channel 156 formed in the spike 150. The first channel 154 opens at the tip 152 and in fluid communication with the fluid port 158. The second channel 156 opens at the tip 152 and in air communication with the first chamber 130. A filter 154*c* may be provided along the second channel 156 for filtering the air flowing through the second channel 156.

Vial adaptor 100 includes a front stopper 160 which plugs and seals the front opening 112 of the first chamber 130 in a fluid-tight manner. Front stopper 160 may be made of resiliently expandable material such as rubber or thermoplastic elastomer to allow piercing through by the spike 150 while maintaining the fluid-tight property before the spike 150 piercing through and after the spike 150 is retrieved.

Vial adaptor 100 includes a cap 180 having a cap seat 181 attached to the back opening 128 of the second housing 120 and a lid 182 pivotally coupled to the cap seat 182, to ease the operation of the vial adaptor 100. The lid 182 may have an ergonometrically rounded profile to facilitate easy pushing action against the second housing 120. The lid 182 may cover a valve member 170 coupled to the fluid port 158 of the first channel 154, or alternatively a septum 171 sealed to the fluid port 158, to prevent contamination to the valve member 170 or the septum 171. Vial adaptor 100 includes a clamp element 190 coupled to the front opening 112. The clamp element 190 has claws 192 formed thereon for attaching the vial adaptor 100 to a vial 12 for fluid medicine transfer, as described in further details below.

Figure 4A:
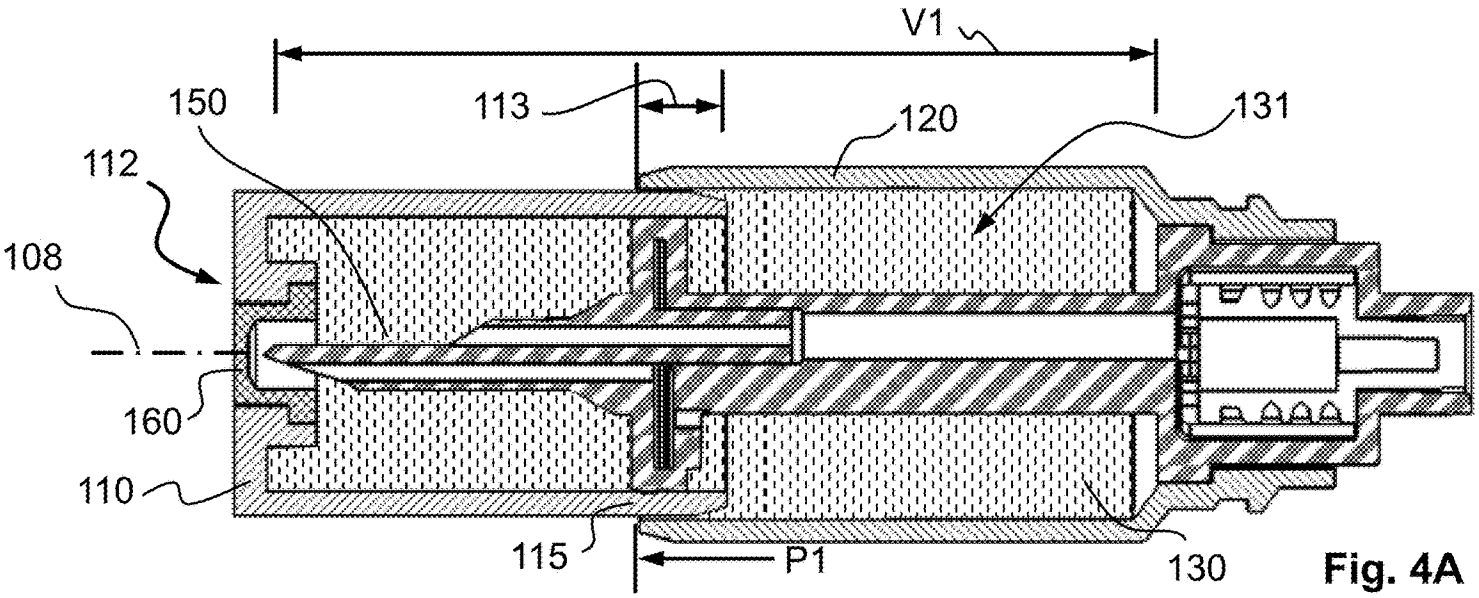
FIG. 4A is a cross sectional partial view of the vial adaptor of FIG. 1 before the second housing is slid toward the second position, where some components are omitted for clear illustration of remaining components.
Figure 4E:
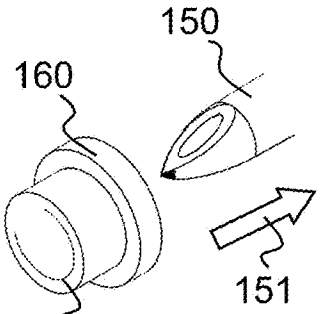
FIG. 4E is a perspective view showing a spike of the vial adapter of FIG. 1 withdrawn from a front stopper of the vial adapter after the vial adaptor has been used to transfer medical fluid between the vial and the syringe.
Figure 4B:
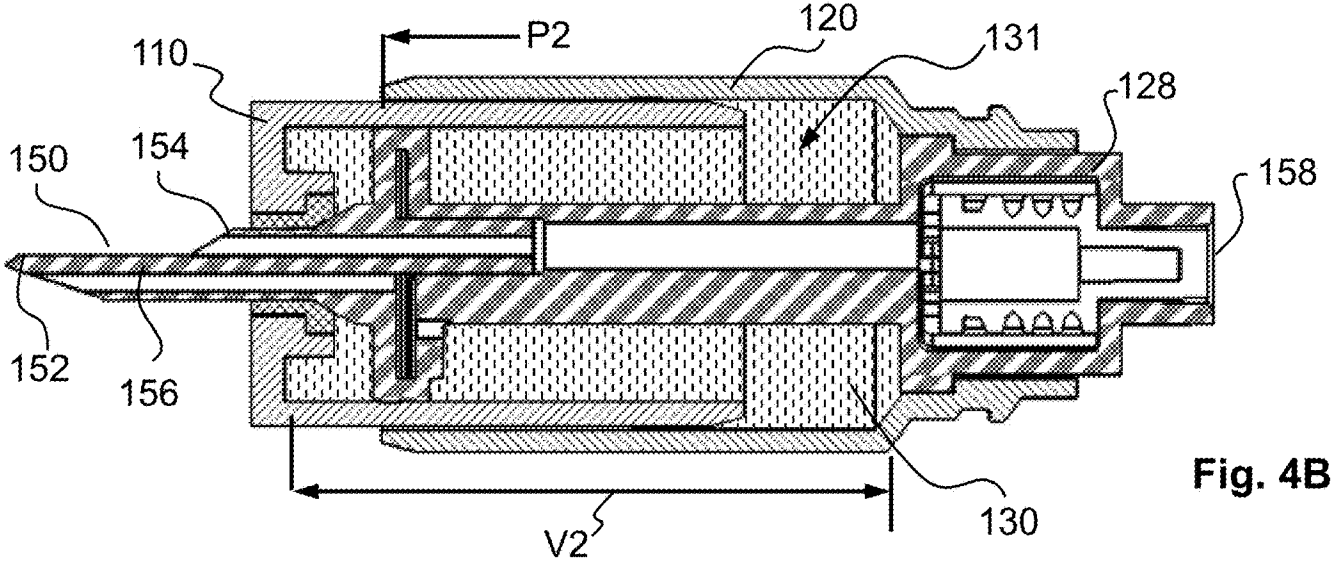
FIG. 4B is a cross sectional partial view of the vial adaptor of FIG. 1 after a part of the second housing is slid into the second position, in which some components are omitted for clear illustration of remaining components.
Figure 4C:
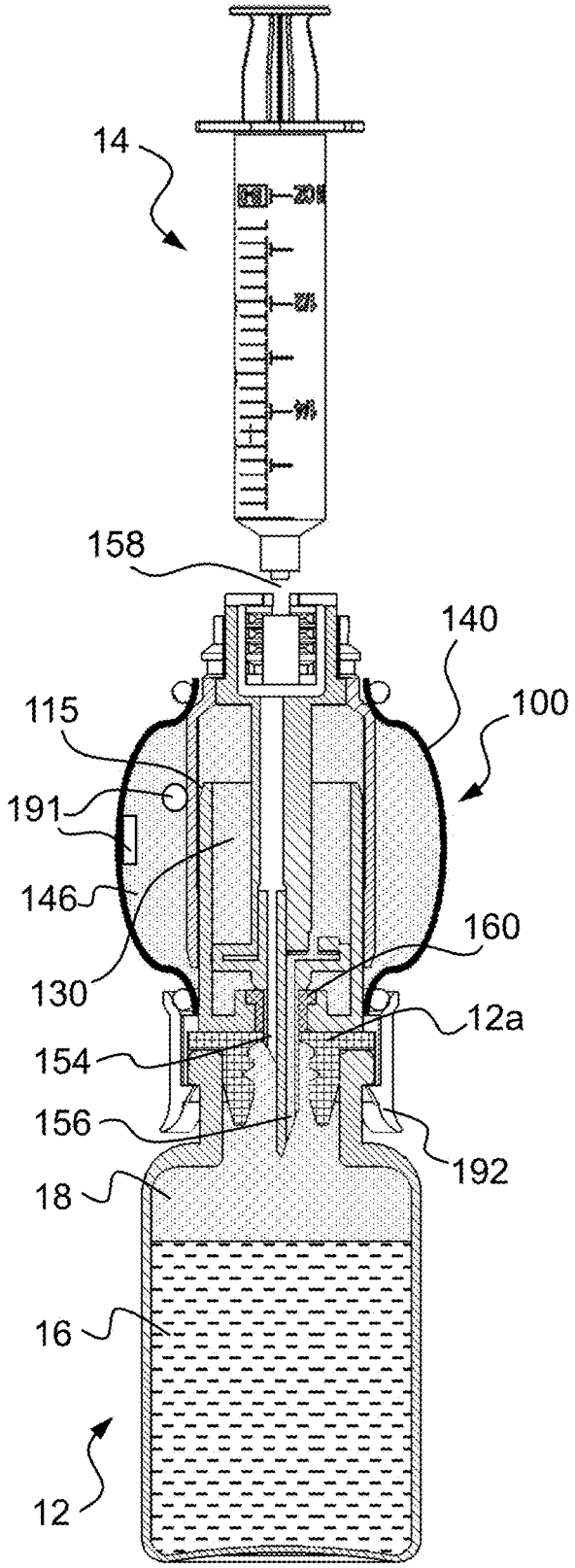
FIG. 4C is a cross sectional partial view of the vial adaptor of FIG. 1 attached to a vial and for connection to a syringe to form a fluid transferring system of FIG. 2, in which some components are omitted for clear illustration of remaining components.
Figure 4D:
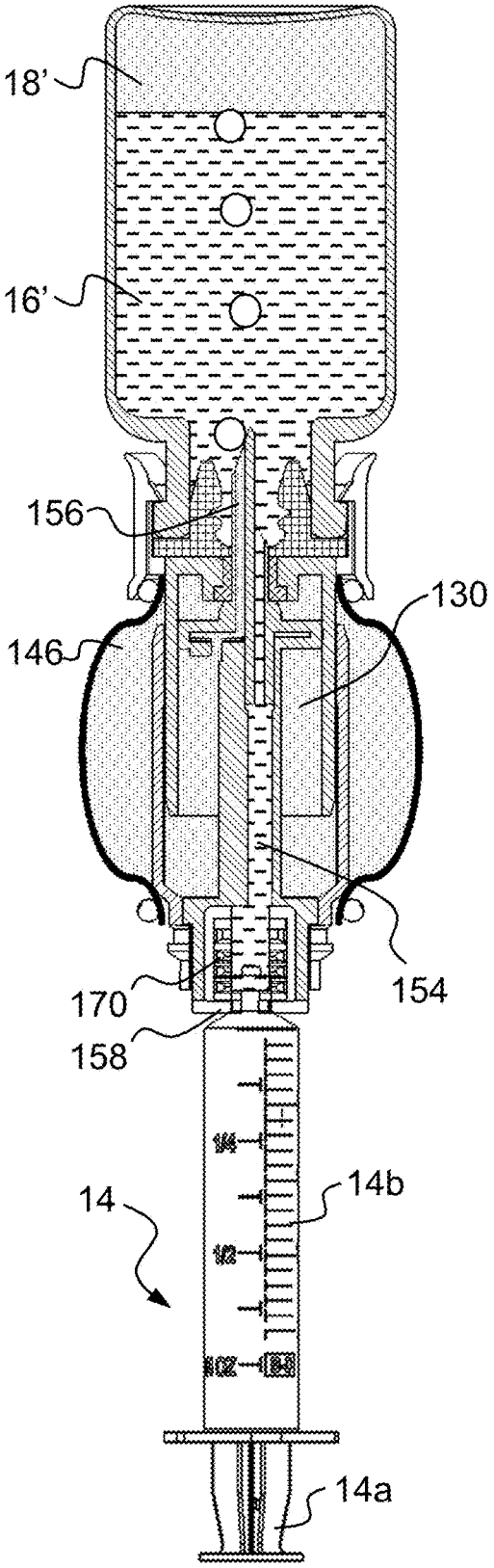
FIG. 4D is a cross sectional partial view of the vial adaptor of FIG. 1 to which a vial and a syringe are connected, in which some components are omitted for clear illustration of remaining components.

In use, as shown in FIGS. 4C and 4D, a vial 12 is positioned upright and attached to the vial adaptor 100 and secured to the front opening 112, by the claws 192 clamping to the vial 12. The second housing 120 is then pushed toward the second position P2. Displacement of the second housing 120 toward the first housing 110 advances the spike 150 to cause the tip 152 to pierce through the front stopper 160 and the vial stopper 12*a*, and enters the vial 12. Upon the tip 152 being positioned in the vial 12, the first channel 154 and second channel 156 become in fluid communication with the internal space of the vial 12 by which, the first channel 154 establishes fluid communication between the fluid port 158 and the internal space of the vial 12. With the second housing 120 sliding toward the second position P2, the volume of the first chamber 130 is reduced from V1 to V2, by which, the air in the first chamber 130 is forced to enter the second chamber 146 and unflexes/expands the sheath 140.

The second channel 156 establishes air communication between the first chamber 130 and the vial 12. When the vial 12 is at the upright position as shown in FIG. 4C, the fluid contents is not in contact with the vial stopper 12*a*. Further advancement of the spike 150 toward the vial 12 will reduce the air space in the vial 12, and hence pushes the air in the vial 12 into the first chamber 130 through the second channel 156, and the air further enters the second chamber 146 to expand/unflex the sheath 140. The expansion/unflex of the sheath 140 will provide a pressure equalization to the vial 12, such that the air pressure in the vial 12 remains the same as that before the spike 150 is pierced in. In situations where fluid is transferred into the vial, the administration of fluid into the vial 12 will similarly provide pressure equalization effect by the sheath 140.

When it is desired to draw fluid out of the vial 12, a syringe 14 is attached to the fluid port 158 of the vial adaptor 100. The vial 12 is then inverted, as shown in FIG. 4D, such that the tip 152 of the spike 150 is below the fluid level of the vial 12. With the fluid being retracted into the syringe 14, the volume of the remaining fluid 16' in the vial 12 reduces, resulting in increase of the volume in the air space 18' and hence a reduction of air pressure in the air space 18'. The expansion in the air space 18 above the fluid level results in a further pressure reduction upon which air from the first chamber 130 and the second chamber 146 in the expandable sheath 140 enters the vial 12 through the second channel 156 of the spike 150, to compensate the air pressure reduction in the vial 12. The transfer of fluid 16 from the vial 12 to the syringe 14 may therefore take place in a closed volume space with pressure equalization.

The pliable valve member 170 disposed in the fluid port 158 that connects to the syringe 14, keeps the fluid port 158 closed at all times. The valve member 170 has bellow shaped folds that lends a spring like characteristic to the valve member 170 to provide the sealing effect when it is compressed. The action of the tip of a syringe 14 that is connected to the fluid port 158 will cause the valve member 170 to be compressed and expose the first channel 154 on the inside walls of the fluid port 158 to the proximity of the end of the syringe tip, such that fluid communication paths are created. Fluid could flow into and out of the vial 12 through the vial adaptor 100 with the syringe plunger 14*a*'s action retracting from the syringe barrel 14*b* and insertion into the barrel 14*b*, respectively.

In embodiments where a vial adaptor has septum 171 sealed to the fluid port 158 instead of a valve member 170, the septum 171 is configured to be pierceable by a sharp introducer therethrough to form a fluid communication between the vial adaptor and an intermediate device syringe. The septum 171 may be made from a pliable rubber, thermoplastic elastomer or silicon that allows the use of sharp introducers like needles to pierce through to form the fluid communication between the vial adaptor and an intermediate device like a syringe.

When the syringe 14 is disconnected from the vial adaptor 100, the valve member 170 springs back to its initial state causing a suction effect to act on any residue fluid in the valve member 170. The spring back action of the valve member 170 reduces the occurrence of residual fluid from being expelled out of the fluid port 158 and/or appearing on the external surface of the valve member 170.

The vial adaptor 100 allows safe transfer of medications in particular cytotoxic drugs from a vial 12 to a syringe 14. The front stopper 160 and valve member 170 integrated within the vial adaptor 100 minimize the need to clean the surfaces compared to known devices. In addition, the ergonometrically rounded profile of the lid 182 enables easy pushing action to the vial adaptor 100 in piercing the vial stopper 12*a* during operation.

As shown in FIG. 4A, the vial adaptor 100 may include one or more status indicator 191 disposed in the second chamber 146. Status indicator 191 may be a plastic ball, a bead, a sticker or a label coated with appropriate chemical agent which changes a visually identifiable character, for example color, upon the status indicator 191 detects the presence in the second chamber 146 a substance such as aerosols, vapors or other medical contents of certain chemical compound captured from the vial. The status indicator 191 allows a user to be informed of the presence of such aerosols, vapors or the like in the second chamber 146, which indicates a possible situation where such substance is leaked from the vial, and take precautionary measure accordingly. The status indicator 191 may be affixed to the external surface of the first housing 110 and/or the second housing 120, or affixed to an inner surface of the sheath 140.

As shown in FIG. 4E, after the vial adaptor is used in transferring medical fluid from between a vial and a syringe and with the spike 150 withdrawn at direction 151, the front stopper 160 has a visible piercing marking 161 upon being pierced through by the spike 150. The visible piercing marking 161 provides an indication that the vial adaptor 100 has been used so as to prevent re-use of the vial adaptor for hygienic considerations.

FIGS. 5 to 9 depict another embodiment of a vial adaptor 200. The vial adaptor system 200 comprises a first housing 210, a second housing 220 coupled to first housing 210 to form a first chamber 230 therein. A flexible sheath 240 encloses and secured to the first and second housings 210, 220 in an air-tight manner, to form a second chamber 246 between the sheath 240 and the external side of the first and second housings 210, 220. The vial adaptor 200 includes a spike 250 disposed in the first chamber 230, with a back end fixed to the second housing 220.

Figure 5:
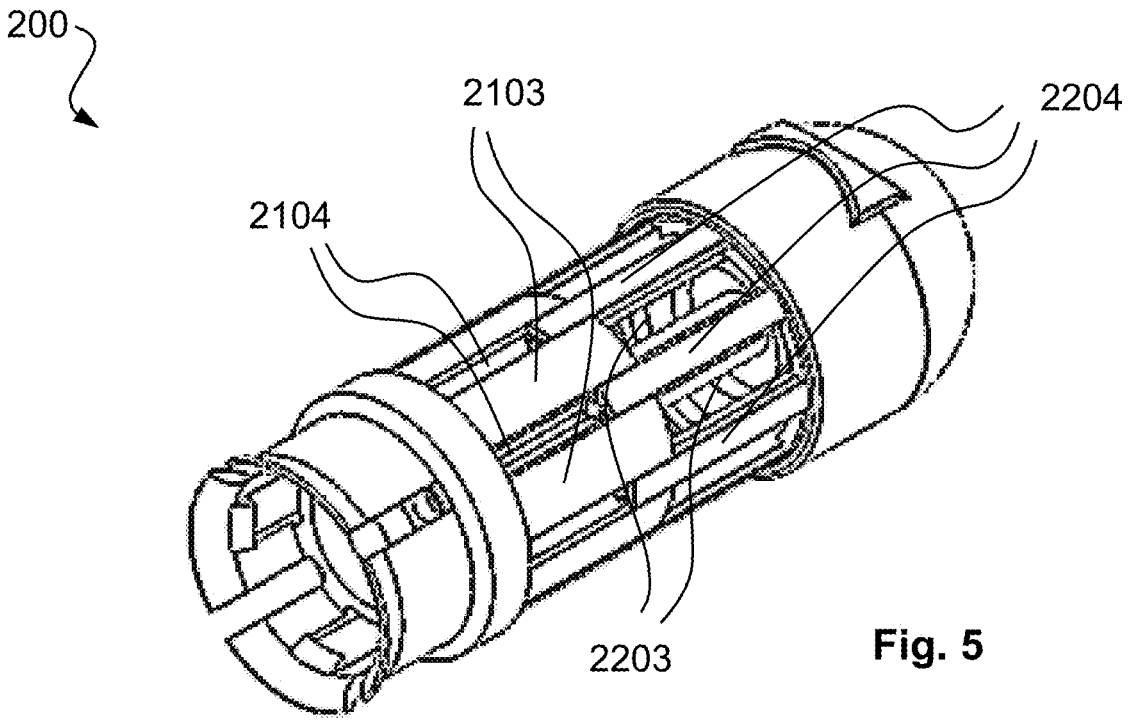
FIG. 5 is a perspective view of a vial adaptor according to another embodiment of the present invention.
Figure 6:
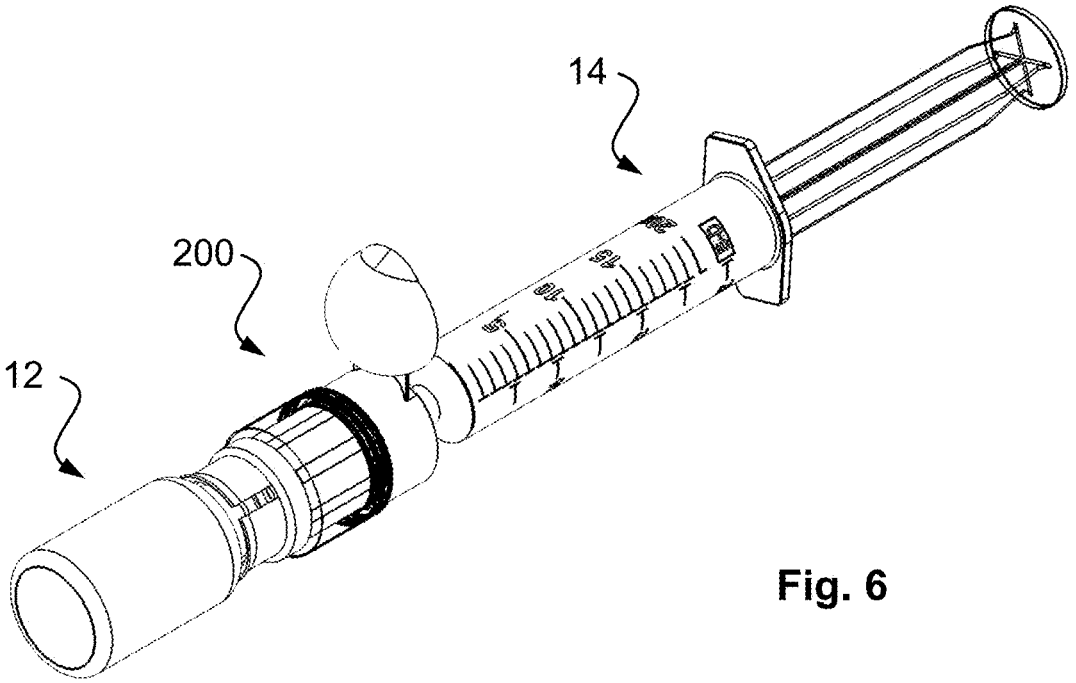
FIG. 6 is a perspective view of a fluid transferring system in which a vial adaptor of FIG. 5 is attached to a vial and a syringe.

Vial adaptor 200 of the present embodiment works under similar principles as, and structured in a manner similar to, the vial adaptor 100 as illustrated above, for transferring fluid between a vial 12 and a syringe 14. The differences lie in the aspects that, in the present embodiment, the first housing 210 is in the form of a hollow cylindrical shape, having a plurality of annularly distributed, axially-aligned grooves 2104 formed on an external surface of the first housing 210. Between adjacent two axial grooves 2104 there are formed axial ridges 2103. The second housing 220 has a base 2202 and spaced-apart columns 2204 extending from the base 2202 along axial direction, and toward the first housing 210. Columns 2204 have the same number and relative position as the axial grooves 2104, and are formed of cross sectional shape and dimension complementary to the axial grooves 2104. As such, when the first housing 210 and the second housing 220 are coupled to each other, each column 2204 is received into a corresponding one of the axial grooves 2104, as shown in FIG. 5, to enable and guide the second housing 220 to slide relative to the first housing 210 along an axial direction.

Between adjacent columns 2204 there are formed axial gaps 2203 which take the cross sectional shape and dimension complementary to the axial ridges 2103. When the first housing 210 and the second housing 220 are coupled to each other, each axial ridge 2103 is received into a corresponding one of the axial gaps 2203. The axial ridges 2103 are shorter than the axial gaps 2203 and therefore, axial gaps 2203 serve as the communication channel between the first chamber 230 and the second chamber 246 to enable air flow therethrough. Another words, axial gaps 2203 form air-passing windows between the first chamber 230 and the second chamber 246.

Figure 7A:
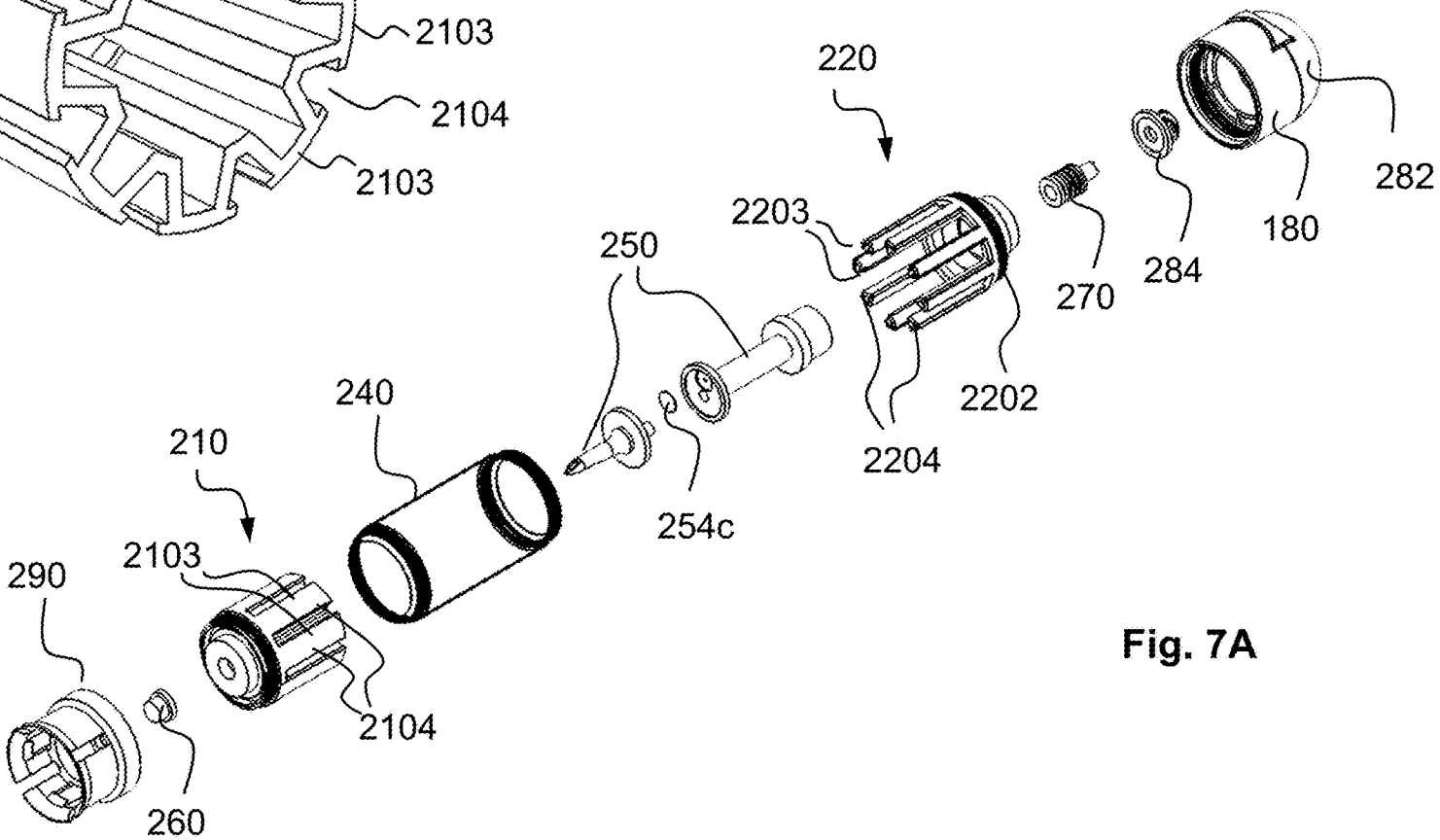
FIG. 7A is an exploded view of the vial adaptor of FIG. 5.
Figure 7D:
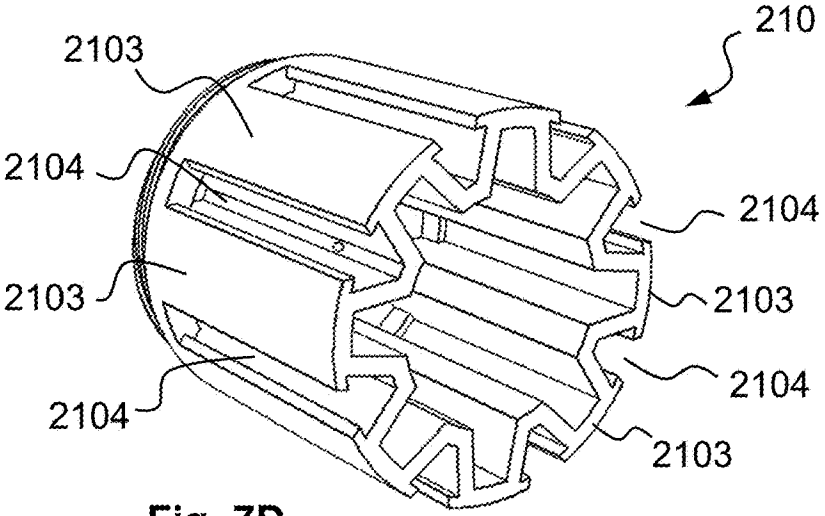
FIG. 7D is an enlarged perspective view of the second housing of the vial adaptor of FIG. 5, viewing from another angle.
Figure 7B:
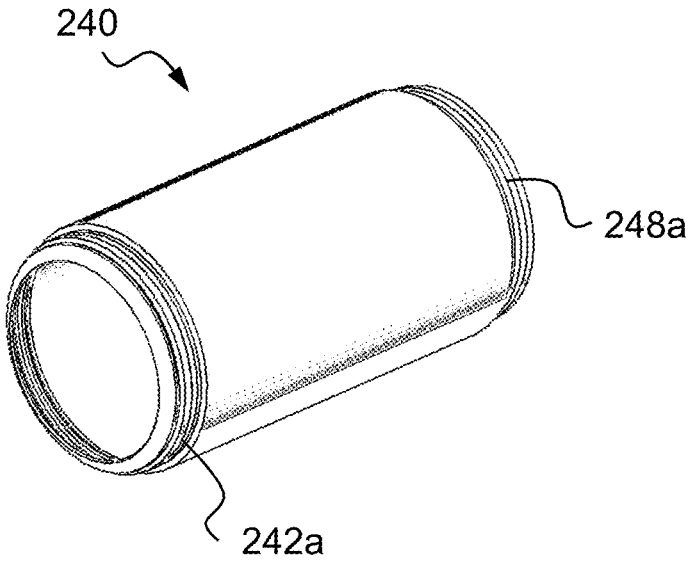
FIG. 7B is an enlarged view of the sheath of the vial adaptor of FIG. 5, according to one embodiment.

As shown in FIG. 7B, sheath 240 has shoulders 242*a*, 248*a* formed at the rim of the first opening 242 and second opening 248, respectively. When the sheath 240 is assembled to the first and second housings 210, 220, shoulders 242*a* and 248*a* rests against the end surface 210*a*, 220*a* of the first and second housings 210, 220, respectively.

Figure 7C:
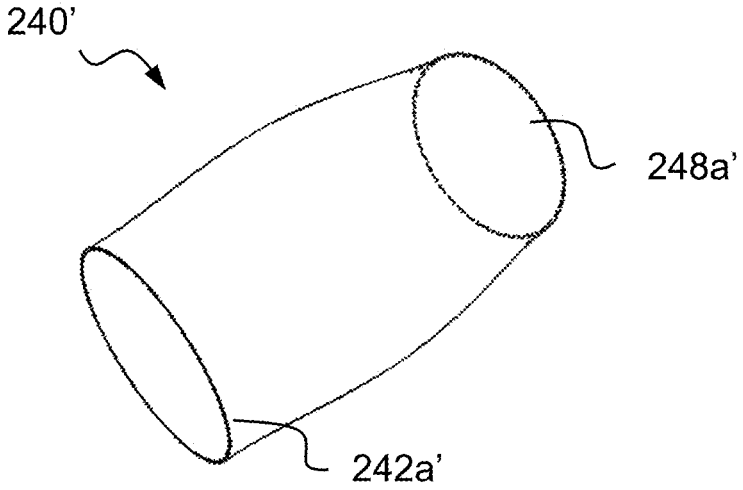
FIG. 7C is an enlarged view of the sheath of the vial adaptor of FIG. 5, according to another embodiment.

Alternatively, as shown in FIG. 7C, a sheath 240' may be formed with flat rims 242*a*', 248*a*' without shoulder structure. The above-illustrated shoulder structures may be created when the tubular pliable sheath 240' is heat shrank at the proximity where it overlaps with the screw threads formed at the rim of first and second housings 210, 220, and are not necessarily features formed before assembly.

Figure 8A:
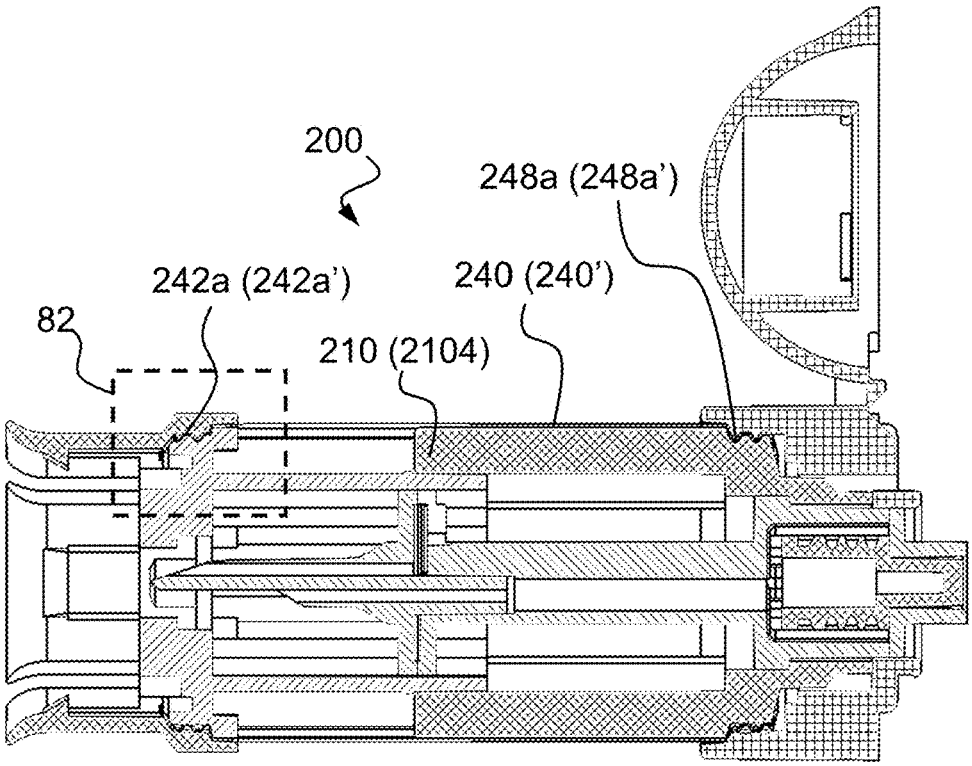
FIG. 8A is a cross sectional partial view of the vial adaptor of FIG. 5 before the second housing is slid toward the first housing.
Figure 8B:
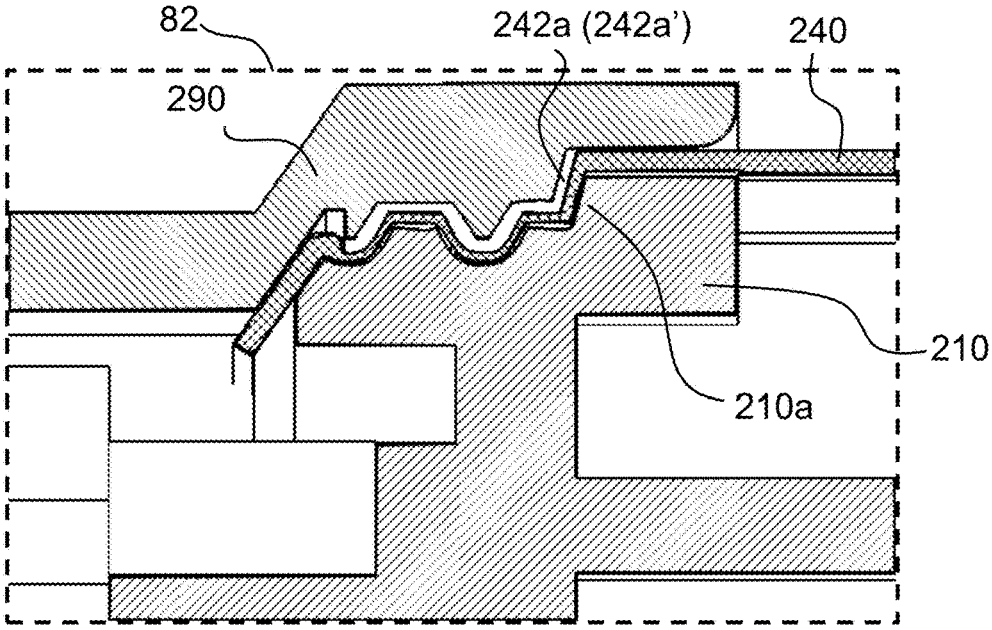
FIG. 8B is a partial enlarged view of portion 82 of FIG. 8A.
Figure 9:
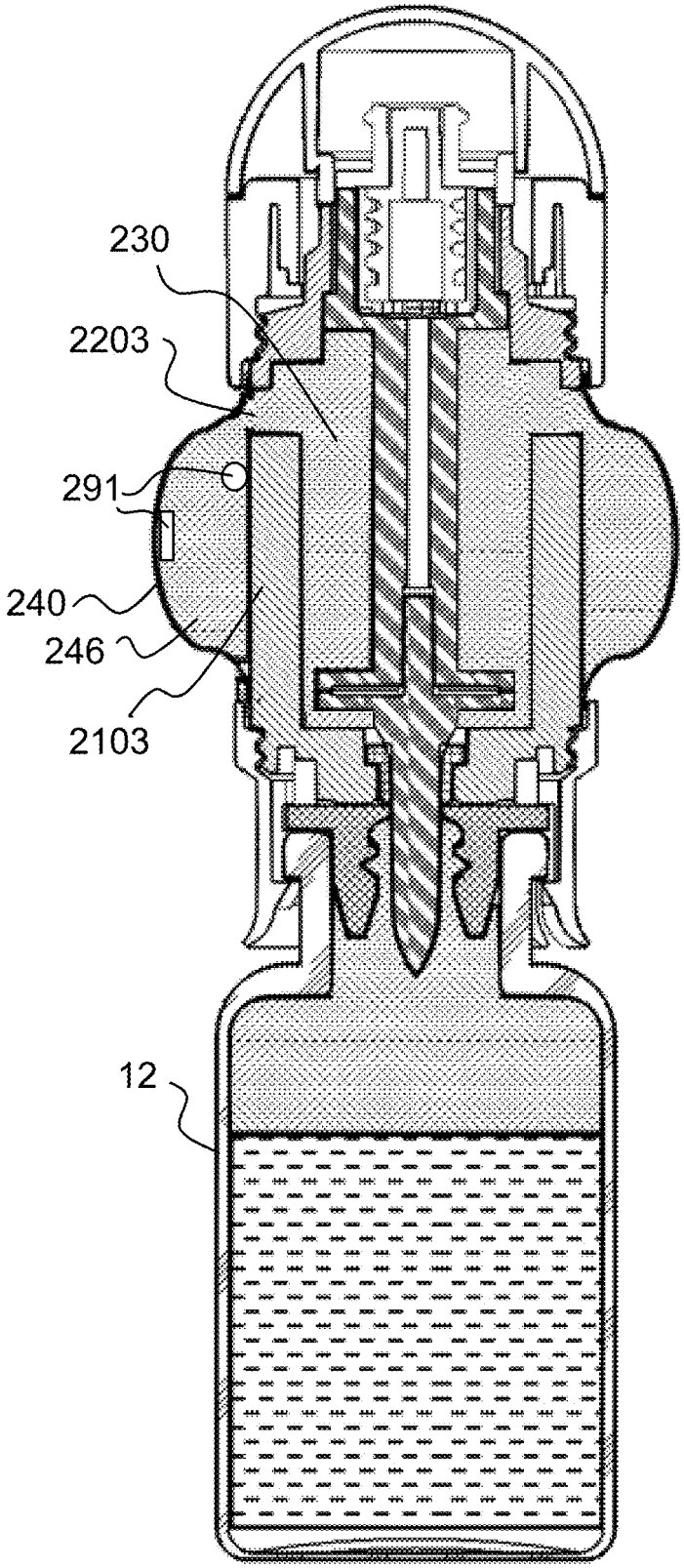
FIG. 9 is a cross sectional partial view of the fluid transferring system of FIG. 6 after the second housing is slid into the first housing and the spike protruding out of the first housing and positioned in the vial.

The vial adaptor 200 includes a cap 280 and a clamp element 290. The cap 280 is attached to the second housing 220 via screw threads fastening. The shoulder 248*a* of sheath 240, or alternatively shoulder 248*a*' of sheath 240', firmly secure one end of the sheath 240 to the end surface 220*a* of the second housing 220. Likewise, the clamp element 290 is attached to the first housing 210 via screw thread fastening, the shoulder 242*a* of sheath 240, or alternatively shoulder 242*a*' of sheath 240', firmly secure another end of the sheath 240' to the end surface 210*a* of the first housing 210, as shown in FIGS. 8A and 8B. The shoulders

242*a*, 248*a*, 242*a*', 248*a*' together with the screw-fastened cap 280 and clamp element 290 provide an alternate solution to firmly secure the sheath 240' to the first and second housings 210, 220, as compared to the solution of using O-rings as illustrated in the previous embodiment.

The vial adaptor 200 may include one or more status indicator 291 disposed in the second chamber 246, in a manner similar to the vial adaptor 100 of the previous embodiment, and serves the same purpose.

This disclosure has been presented for purposes of illustration and description and is not intended to be exhaustive or limiting. Many modifications and variations will be apparent to those of ordinary skill in the art. The example embodiments were chosen and described in order to explain principles, technical solutions and practical applications, and to enable others of ordinary skill in the art to understand the disclosure for various embodiments with various modifications as are suited to the particular use contemplated.

Thus, although illustrative example embodiments have been described herein with reference to the accompanying drawings, it is to be understood that this description is not limiting and that various other changes and modifications may be affected therein by one skilled in the art without departing from the scope or spirit of the disclosure.

The invention claimed is:

1. A vial adaptor comprising:

a first housing;

a second housing movably coupled to the first housing, the first housing and the second housing form a first chamber therein;

a spike disposed in the first housing and the second housing, the spike having:

a tip positioned adjacent to a front end of the first housing, a fluid port connected to a back end of the second housing, a first fluid channel opening at the tip and connected to the fluid port, and a second fluid channel opening at the tip and connected to the first chamber;

a sheath surrounding the first housing and the second housing to form a second chamber between the sheath and an external surface of the first housing and the second housing, wherein the second chamber is in air communication with the first chamber, and wherein displacement of the second housing toward the first housing advances the tip of the spike to protrude out of the first housing and vary a volume of the first chamber.

2. The vial adaptor of claim 1, wherein the first housing is a first sleeve and the second housing is a second sleeve telescopically coupled to the first sleeve, the first and second sleeves form an annular gap therebetween to establish air communication between the first chamber and the second chamber.

3. The vial adaptor of claim 2, wherein the first sleeve and the second sleeve are partially overlapped to each other at a segment along which the annular gap is positioned.

4. The vial adaptor of claim 1, wherein the first housing has a plurality of axial grooves disposed along an annular direction thereon, the second housing has a plurality of spaced apart columns projecting from a base thereof and a gap between adjacent two columns, wherein each column is received in one of the corresponding grooves, and the first chamber and the second chamber are in air communication through each of the gaps.

5. The vial adaptor of claim 1, further comprising a clamp element attached to the first housing for securing the first housing to a vial.

6. The vial adaptor of claim 5, wherein the sheath has a first annular shoulder formed at a first opening thereof, wherein the first annular shoulder is secured between the first housing and the clamp element.

7. The vial adaptor of claim 5, further comprising a first O-ring to grip the sheath to the first housing, wherein the first O-ring is secured between the first housing and the clamp element.

8. The vial adaptor of claim 6, further comprising a cap having a cap seat attached to the second housing and a lid pivotally coupled to the cap seat to cover the fluid port.

9. The vial adaptor of claim 8, wherein the sheath has a second annular shoulder formed at a second opening thereof, wherein the second annular shoulder is secured between the second housing and the cap seat.

10. The vial adaptor of claim 7, further comprising a second O-ring to fix the sheath to the second housing, wherein the second O-ring is secured between the second housing and the cap seat.

11. The vial adaptor of claim 1, further comprising a front stopper sealed to the first housing and disposed in front of the tip.

12. The vial adaptor of claim 11, wherein displacement of the second housing toward the first housing advances the tip of the spike to pierce through the front stopper to protrude out of the first housing.

13. The vial adaptor of claim 12, wherein the front stopper has a visible piercing marking upon being pierced through by the spike.

14. The vial adaptor of claim 1, further comprising a valve member coupled to the fluid port for sealing the fluid port.

15. The vial adaptor of claim 14, wherein the valve member is resiliently deformable to open the fluid port upon insertion of a syringe tip into the valve member.

16. The vial adaptor of claim 1, further comprising an air filter coupled along the second fluid channel.

17. The vial adaptor of claim 1, wherein the sheath is expanded upon displacement of the second housing toward the first housing causing air entering the second chamber.

18. The vial adaptor of claim 1, wherein the sheath is collapsed upon air drawn from second chamber.

19. The vial adaptor of claim 1, wherein upon a vial being attached to the vial adaptor, the displacement of the second housing toward the first housing advances the tip of the spike to protrude out of the first housing and positioned in the vial to establish air and fluid communication with an internal space of the vial.

20. The vial adaptor of claim 19, wherein the displacement of the second housing toward the first housing causes an excessive air in the first chamber to enter the second chamber through the vial.

21. The vial adaptor of claim 1, wherein the first chamber is filled with sterilized air therein.

22. The vial adaptor of claim 1, further comprising a septum sealed to the fluid port.

23. The vial adaptor of claim 22, wherein the septum is configured to be pierceable by a sharp introducer therethrough to form a fluid communication between the vial adaptor and an intermediate device syringe.

24. The vial adaptor of claim 1, further comprising a status indicator disposed in the second chamber, wherein a visually identifiable character of the status indicator varies upon the status indicator detecting a presence in the second chamber of a substance from a vial connected to the vial adaptor.

25. The vial adaptor of claim 24, wherein the status indicator is affixed to the external surface of the first housing.

26. The vial adaptor of claim 24, wherein the status indicator is affixed to the external surface of the second housing.

27. The vial adaptor of claim 24, wherein the status indicator is affixed to an inner surface of the sheath.

28. A fluid transfer system comprising:

the vial adaptor as recited in claim 1, a vial attached to the front end of the first housing of the vial adaptor, the vail vial having a liquid sealed therein;

a syringe attached to the fluid port of the spike;

wherein upon protruding out of the first housing, the tip of the spike is positioned in the vial and an excessive air in the first chamber enters the second chamber through the vial, and upon the liquid of a volume being drawn out of the vial into the syringe through the second fluid channel of the spike, a supplement air from the first chamber enters the vial to fill the volume in the vial.

29. The fluid transfer system of claim 28, wherein the sheath is expanded upon the excessive air enters the second chamber.

30. The fluid transfer system of claim 28, wherein the sheath is collapsed upon the supplement air from the first chamber enters the vial.

31. The fluid transfer system of claim 28, further comprising a clamp element attached to the first housing of the vial adaptor to secure the first housing to the vial.

* * * * *